US009842710B2

(12) United States Patent
Maruyama

(10) Patent No.: US 9,842,710 B2
(45) Date of Patent: Dec. 12, 2017

(54) KEY SWITCH DEVICE AND KEYBOARD

(71) Applicant: FUJITSU COMPONENT LIMITED, Tokyo (JP)

(72) Inventor: Junichi Maruyama, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/796,215

(22) Filed: Jul. 10, 2015

(65) Prior Publication Data

US 2016/0093455 A1 Mar. 31, 2016

(30) Foreign Application Priority Data

Sep. 26, 2014 (JP) ..... 2014-197484

(51) Int. Cl.
*H01H 13/705* (2006.01)
*H01H 13/7065* (2006.01)
(Continued)

(52) U.S. Cl.
CPC ..... *H01H 13/7065* (2013.01); *H01H 3/125* (2013.01); *H01H 13/702* (2013.01);
(Continued)

(58) Field of Classification Search
CPC .. H01H 3/125; H01H 13/705; H01H 2237/00; H01H 13/7065; H01H 13/702;
(Continued)

(56) References Cited

U.S. PATENT DOCUMENTS 5,901,837 A * 5/1999 Aimi ..... H01H 3/125 200/344
6,747,867 B2 * 6/2004 Hsu ..... G06F 1/1616 200/5 A (Continued)

FOREIGN PATENT DOCUMENTS

CN 2033427 3/1989
CN 2567641 8/2003

(Continued)

OTHER PUBLICATIONS

Patent Abstracts of Japan, Publication No. 2009-76321, published Apr. 9, 2009.

(Continued)

*Primary Examiner* — Anthony R. Jimenez
*Assistant Examiner* — Ahmed Saeed
(74) *Attorney, Agent, or Firm* — Staas & Halsey LLP

(57) ABSTRACT

A key switch device includes: a key top that includes an operating surface; a pair of link members that is interlocked with each other to move the key top upward and downward; a frame member that includes a leg portion extending downward and a flange portion provided at an end of the leg portion, and pivotably supports the pair of the link members; and a support plate that includes a through hole through which the leg portion and the flange portion penetrate, and a projection portion projecting upwardly from a part of an outer periphery of the through hole toward an inside of the through hole.

7 Claims, 12 Drawing Sheets

(51) Int. Cl.
*H01H 3/12* (2006.01)
*H01H 13/702* (2006.01)

(52) U.S. Cl.
CPC . *H01H 2205/002* (2013.01); *H01H 2205/004* (2013.01); *H01H 2215/006* (2013.01); *H01H 2227/004* (2013.01); *H01H 2229/042* (2013.01)

(58) Field of Classification Search
CPC ..... H01H 2205/002; H01H 2227/004; H01H 2205/004; H01H 2215/006; H01H 2229/042
USPC ..... 200/5 A, 344, 341, 314, 329, 343
See application file for complete search history.

(56) References Cited

U.S. PATENT DOCUMENTS

| | | | | |
|---|---|---|---|---|
| 8,481,874 | B2 * | 7/2013 | Takagi | H01H 3/125 200/344 |
| 9,437,378 | B2 * | 9/2016 | Nishino | H01H 3/125 |
| 2004/0163937 | A1 | 8/2004 | Ito | |
| 2008/0035461 | A1 | 2/2008 | Nishino | |
| 2009/0078552 | A1 | 3/2009 | Takemae et al. | |
| 2012/0199458 | A1 | 8/2012 | Takemae et al. | |

FOREIGN PATENT DOCUMENTS

| | | |
|---|---|---|
| CN | 201717160 U | 1/2011 |
| CN | 202189709 U | 4/2012 |
| CN | 102629526 | 8/2012 |
| CN | 103824720 | 5/2014 |
| EP | 0966010 | 12/1999 |
| JP | 2001-167659 | 6/2001 |
| JP | 2002-63826 | 2/2002 |
| JP | 3102695 | 7/2004 |
| JP | 2009-76321 | 4/2009 |
| TW | I231514 | 4/2005 |
| TW | I361442 | 4/2012 |
| TW | I402877 | 7/2013 |
| TW | I407471 | 9/2013 |

OTHER PUBLICATIONS

Patent Abstracts of Japan, Publication No. 2001-167659, published Jun. 22, 2001.
Patent Abstracts of Japan, Publication No. 2002-63826, published Feb. 28, 2002.
Espacenet English Abstract, Publication No. I231514 Published Apr. 21, 2005.
Espacenet English Abstract, Publication No. 201717160 U Published Jan. 19, 2011.
Espacenet English Abstract, Publication No. 202189709 U Published Apr. 11, 2012.
Taiwanese Office Action dated Aug. 12, 2016 in corresponding Taiwanese Patent Application No. 104122970.
Office Action for Chinese Patent Application No. 201510621461.5, dated Mar. 29, 2017.
Espacenet English Abstract for CN 102629526, published Aug. 8, 2016.
Espacenet English Abstract for CN 2033427, published Mar. 1, 1989.
Espacenet English Abstract for CN 2567641, published Aug. 20, 2003.
Espacenet English Abstract for CN 103824720, published May 28, 2014.

* cited by examiner

KEY SWITCH DEVICE AND KEYBOARD

CROSS-REFERENCE TO RELATED APPLICATION

This application is based upon and claims the benefit of priority of the prior Japanese Patent Application No. 2014-197484 filed on Sep. 26, 2014, the entire contents of which are incorporated herein by reference.

FIELD

A certain aspect of the embodiments is related to a key switch device and a keyboard.

BACKGROUND

Conventionally, there is known a key switch device having a gear link structure in which a pair of link members is assembled to be interlocked by meshing their ends with each other (for example, see Japanese Patent Laid-Open No. 2009-76321).

A key switch device includes a key top, the pair of the link members interlocked with each other to move the key top vertically upward and downward, a support plate, and a frame member for attaching one ends of the link members to the support plate. The frame member is formed with bearing portions into which pivot shaft portions provided in the pair of the link members are fitted respectively. Also, the frame member has leg portions extending vertically downward. The support plate has circular-shaped through holes through which the leg portions of the frame member respectively penetrate.

The bearing portions of the frame member respectively receive the pivot shaft portions of the link members, and the leg portions of the frame member respectively penetrate through the through holes of the support plate, whereby the pair of the link members is pivotally attached on the support plate. Ends of the leg portions of the frame member respectively penetrating through the through holes of the support plate are deformed by thermal caulking, which fixes the frame member on the support plate.

SUMMARY

According to an aspect of the present invention, there is provided a key switch device that includes: a key top that includes an operating surface; a pair of link members that is interlocked with each other to move the key top upward and downward; a frame member that includes a leg portion extending downward and a flange portion provided at an end of the leg portion, and pivotably supports the pair of the link members; and a support plate that includes a through hole through which the leg portion and the flange portion penetrate, and a projection portion projecting upwardly from a part of an outer periphery of the through hole toward an inside of the through hole.

The objects and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIGS. 10A through 10D are views illustrating variations of the arrangement of the four oblong holes;

DESCRIPTION OF EMBODIMENTS

Incidentally, when the link member deforms, the link member is detached from the bearing portion of the frame member, or defective contact of the membrane sheet occurs, that is, in a case of a defect in the key switch device, the key switch device needs to be disassembled and repaired.

Since the frame member is, however, fixed on the support plate by thermal caulking, it is not easy to detach the link members and the frame member from the support plate, and it is difficult to disassemble and repair the key switch device.

The following will describe embodiments according to the present invention with reference to drawings.

Figure 1:
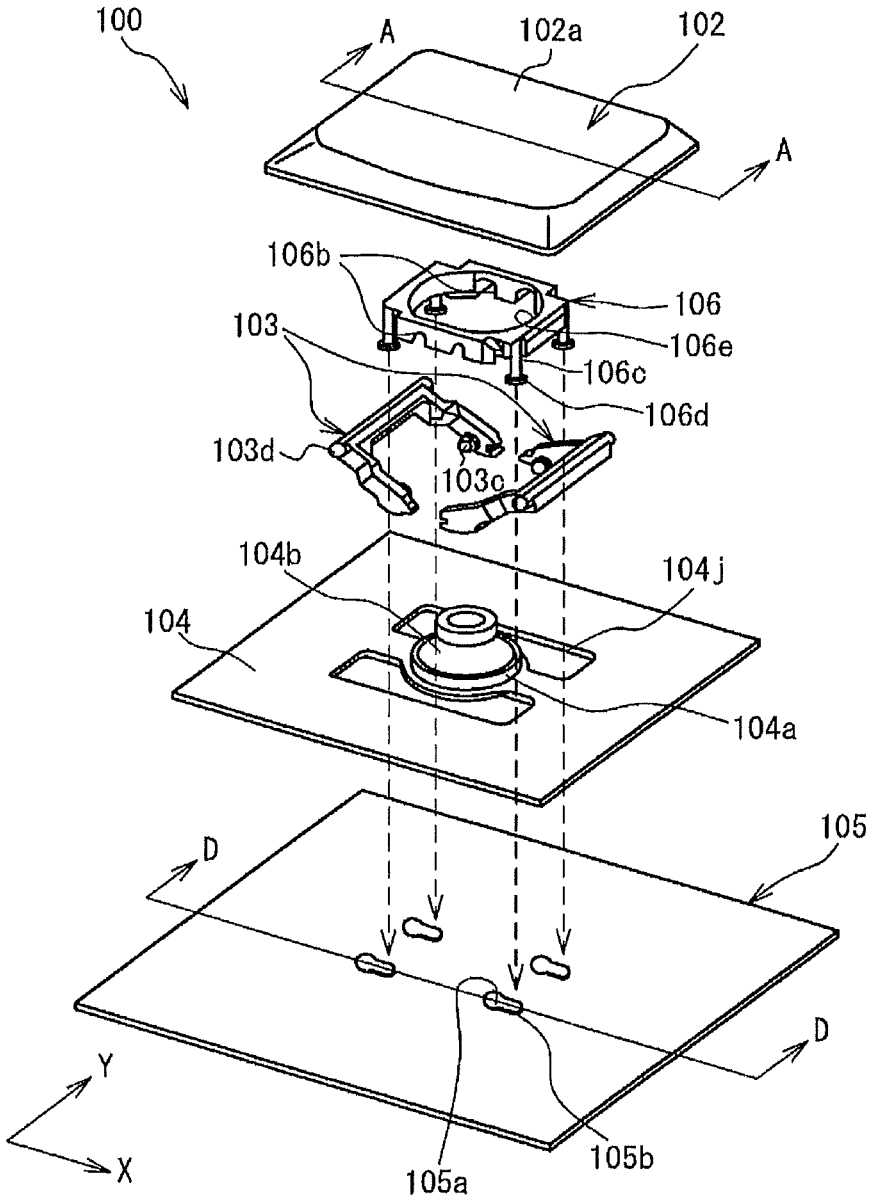
FIG. 1 is a structural view of a key switch device according to the present embodiment.
Figure 2:
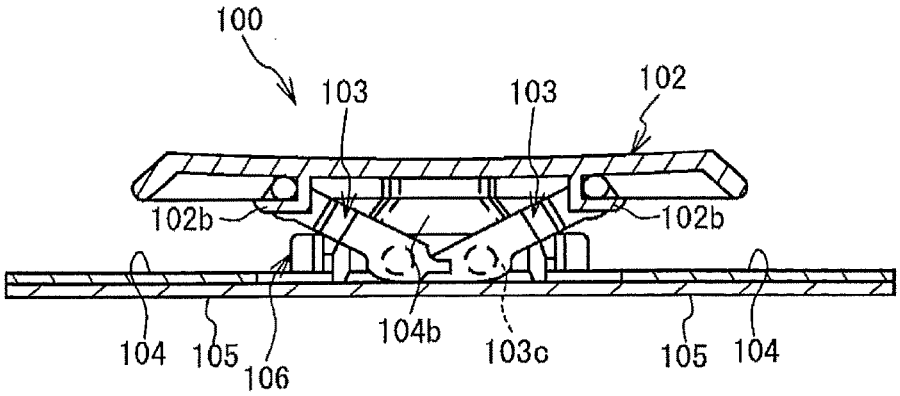
FIG. 2 is a sectional view of the key switch device take along A-A line of FIG. 1.
Figure 3:
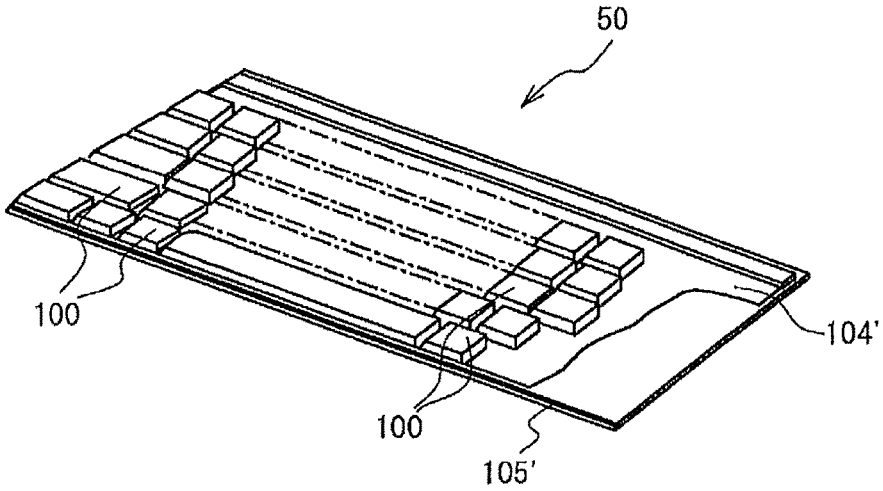
FIG. 3 is a structural view of a keyboard.

FIG. 1 is a structural view of a key switch device 100 according to the present embodiment. FIG. 2 is a sectional view of the key switch device 100 taken along line A-A of FIG. 1. FIG. 3 is a structural view of a keyboard 50.

The key switch device 100 illustrated in FIG. 1 includes a key top 102 having an operating surface 102*a* which an operator pushes down, a pair of link members 103 supporting the key top 102 and interlocked with each other so as to move the key top 102 vertically upward and downward, and a frame member 106 for fixedly attaching ends of the link members 103 on a support plate 105 having a flat plate shape. A membrane sheet 104 including contacts (not illustrated) functioning as a switch is provided on the support plate 105. As illustrated in FIG. 2, a back surface of the key top 102 is formed with guide portions 102*b* for slidably guiding slide portions 103*d* of the link members 103 described later.

Plural key switch devices 100 illustrated in FIG. 1 are arranged in the keyboard 50 illustrated in FIG. 3. A membrane sheet 104' and a support plate 105' each having a large size in common with all key switch devices 100 are included in the keyboard 50. The key top 102, the link members 103, and the frame member 106 are provided for every key switch device 100.

Figure 4:
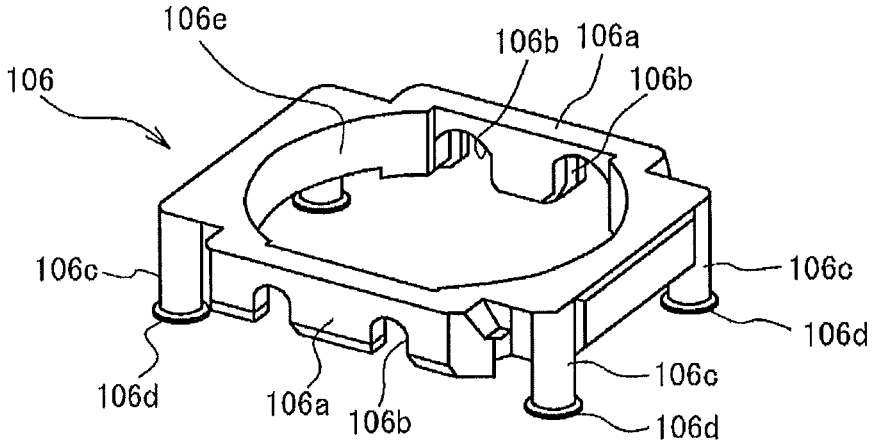
FIG. 4 is a structural view of a frame member.

FIG. 4 is a structural view of the frame member 106. As illustrated in FIG. 4, the frame member 106 is a frame-shaped member made of a resin and having a substantially rectangular shape in plan view. A frame portion 106*a* is formed with bearing portions 106*b* into which pivot shaft portions 103*c* of the link members 103 described below are pivotably fitted respectively. Further, the frame member 106 includes leg portions 106*c* extending vertically downward and respectively inserted into oblong holes 105*a* of the support plate 105, flange portions 106*d* respectively provided horizontally in the ends of the leg portions 106*c* and each having a disk shape, and a through hole 106*e* through which an opening end 104*a* of the membrane sheet 104 and a dome rubber 104*b* penetrate when the frame member 106 is attached to the support plate 105. When the leg portions 106*c* and the flange portions 106*d* are respectively inserted into the oblong holes 105*a* of the support plate 105, a bottom portion of the frame member 106 (that is, the bottom portion of the frame member 106 other than the leg portions 106*c* and the flange portions 106*d*) comes into contact with an upper surface of the support plate 105.

Figure 5:
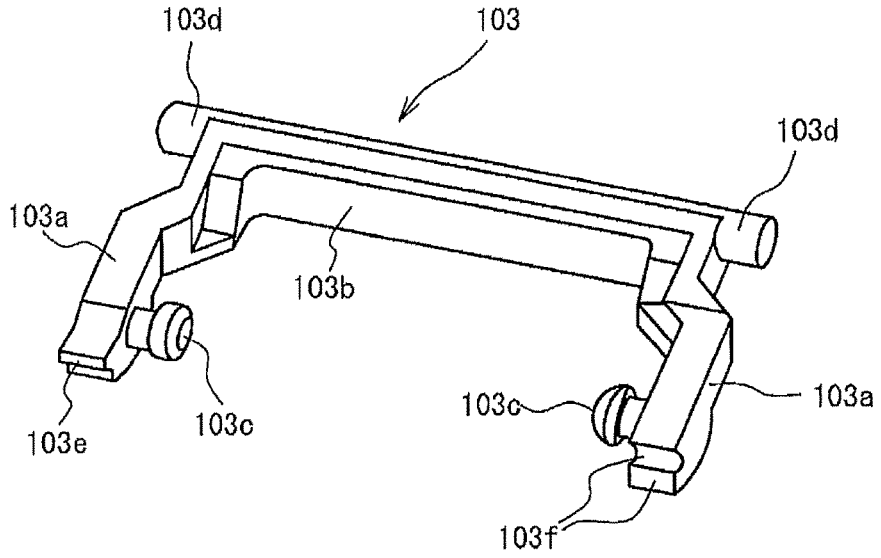
FIG. 5 is a structural view of a link member.

FIG. 5 is a structural view of the link member 103. Since each of the link members 103 of this embodiment has the same shape, FIG. 5 illustrates the single link member 103. The link members 103 are made of resin, and the ends thereof are meshed with each other to be assembled and interlocked with each other. The link member 103 is a V-shaped gear link in side view when the key top 102 is positioned at an upper limit position of the upward and downward movement. Each link member 103 includes arm portions 103*a* extending in substantially parallel with each other in the same direction, and a body portion 103*b* connecting between the arm portions 103*a*.

In FIG. 5, a peripheral region around distal ends of both arm portions 103*a* spaced away from the body portion 103*b* is defined as a first end region of the link member 103. Also, a peripheral region around proximal ends of both arms portions 103*a* adjacent to the body portion 103*b* is defined as a second end region of the link member 103.

In the first end region of each link member 103, inner side surfaces of the arm portion 103*a* facing each other are respectively provided with the pivot shaft portions 103*c* having a projection shape. Also, in the second end region of each link member 103, outer side surfaces of the arm portion 103*a* facing away from each other are respectively provided with the slide portions 103*d* having a projection shape. Further, one of the arm portions 103*a* is provided with a first teeth portion 103*e* in the first end region, and the other of the arm portions 103*a* is provided with a second teeth portion 103*f* in the first end region. Each link member 103 is located between the membrane sheet 104 and the key top 102, in a state where the pivot shaft portions 103*c* in the first end region are pivotally fitted into the respective bearing portions 106*b* of the frame member 106 and where the slide portions 103*d* in the second end region are slidably fitted into the respective guide portions 102*b* (see FIG. 2) provided on the back surface of the key top 102. In this state, the first teeth portion 103*e* of one of the link members 103 is meshed with the second teeth portion 103*f* of the other of the link members 103 to be interlocked with each other. Thus, the pair of the link members 103 is interlocked with each other and respectively pivoted about the pivot shaft portions 103*c*.

Figure 6:
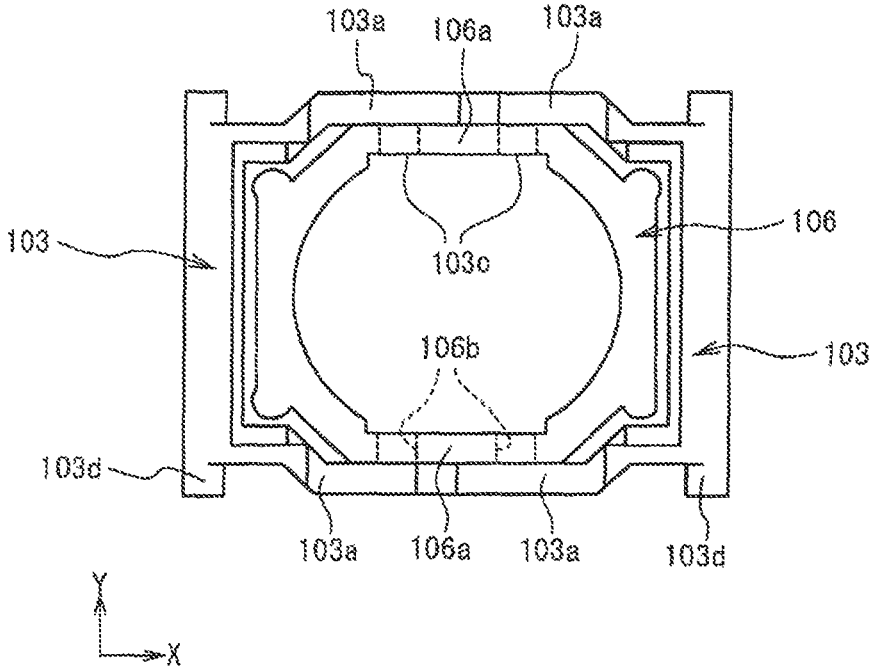
FIG. 6 is a view illustrating a positional relationship between the frame member and a pair of the link members.

FIG. 6 is a view illustrating a positional relationship between the frame member 106 and the link member 103. When the key top 102 is located at a lower limit position of the upward and downward movement, the frame member 106 is located inside the link members 103. Since the pivot shaft portions 103*c* of each link member 103 are pivotally fitted into the respective bearing portions 106*b* of the frame member 106, even when the frame member 106 and the link member 103 slide in the X direction and the Y direction of FIG. 6 (that is, in the horizontal direction), each link member 103 is not detached from the frame member 106.

Returning to FIG. 1, the membrane sheet 104 is made of a transparent material. The membrane sheet 104 includes through holes 104*j* for fixing the frame member 106 and the link member 103 to the support plate 105, and the opening end 104*a*. The opening end 104*a* is attached with the dome rubber 104*b* that generates the reaction force against the force pushing down the key top 102.

Figure 7:
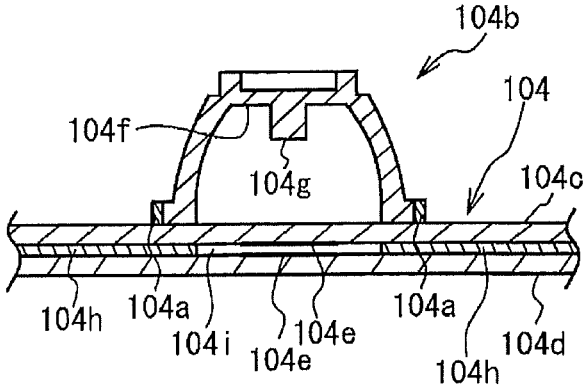
FIG. 7 is a sectional view of a membrane sheet.

FIG. 7 is a sectional view of the membrane sheet 104. As illustrated in

FIG. 7 is a sectional view of the membrane sheet 104. As illustrated in FIG. 7, the membrane sheet 104 includes two substrates 104*c* and 104*d* and a pair of contacts 104*e* corresponding to one of the key switches functioning as a switch. The substrates 104*c* and 104*d* are respectively provided with the contacts 104*e*, and these contacts 104*e* form a pair. The contacts 104*e* of the substrates 104*c* and 104*d* come into contact with each other, so that the contacts 104*e* are brought into an on-state. The substrates 104*c* and 104*d* are spaced away from each other by a predetermined distance, and a spacer 104*h* is provided therebetween. In order for the contacts 104*e* to face each other, they are formed on the respective substrates 104*c* and 104*d* at the position of an aperture 104*i* provided in the spacer 104*h*. A projection 104*g* is formed in a ceiling portion 104*f* of the dome rubber 104*b*. When the key top 102 is pushed down, the dome rubber 104*b* is deformed and buckled, so the projection 104*g* pushes down a portion of the contacts 104*e* formed in the membrane sheet. Thus, the contacts 104*e* come into contact with each other, and a key input is performed.

Figure 8A:
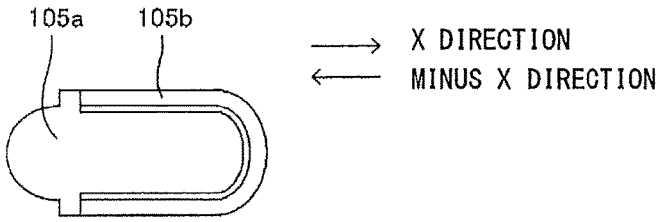
FIG. 8A is a view illustrating a shape of an oblong hole viewed from an upper side.
Figure 8B:
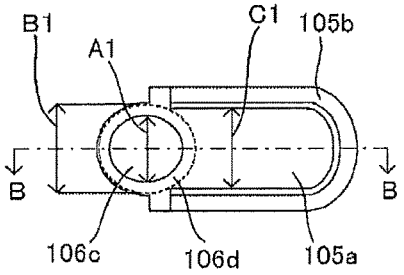
FIG. 8B is a view illustrating a positional relationship among the oblong hole, a leg portion, and a flange portion.
Figure 8C:
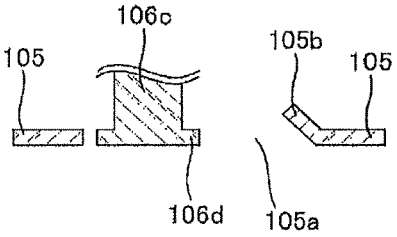
FIG. 8C is a sectional view taken along line B-B of FIG. 8B.
Figure 8D:
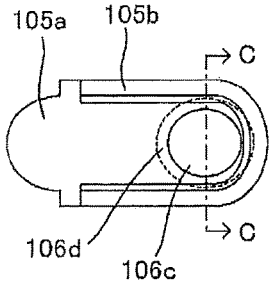
FIG. 8D is a view illustrating the positional relation among the oblong hole, the leg portion, and the flange portion.
Figure 8E:
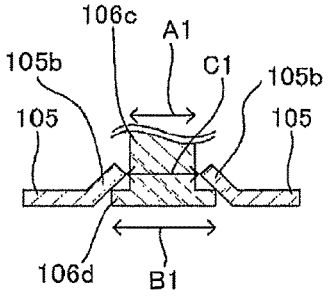
FIG. 8E is a sectional view taken along line C-C of FIG. 8D.

As illustrated in FIG. 1, the support plate 105 is formed with four oblong holes 105*a* for respectively inserting the disk-shaped flange portions 106*d* of the frame member 106 and for fixing the frame member 106. The oblong holes 105*a* are through holes. FIG. 8A is a view illustrating the shape of the oblong hole 105*a* when viewed from the upper side. FIG. 8B is a view illustrating a positional relation among the oblong hole 105*a*, the leg portion 106*c*, and the flange portion 106*d*, FIG. 8C is a sectional view taken along line B-B of FIG. 8B. FIG. 8D is a view illustrating the positional relation among the oblong hole 105*a*, the leg portion 106*c*, and the flange portion 106*d*, FIG. 8E is a sectional view taken along line C-C of FIG. 8D. The shape of the flange portion 106*d* is not limited to a disk shape, but may be also n-polygonal shape (n is integer number of three or more).

As illustrated in FIGS. 8A to 8E, the outer peripheral portion of the oblong hole 105*a* is partially provided with a projection portion 105*b* angularly upwardly protruding from the surface of the support plate 105 toward the inside of the oblong hole 105*a*. The projection portion 105*b* has a U shape in top view. Also, as illustrated in FIGS. 8B and 8E, a width Cl between opposite sides of the projection portion 105*b* (that is, a width of the inside of the U shape) is greater than a diameter A1 of the leg portion 106*c*, but is smaller than a diameter B1 of the disk-shaped flange portion 106*d*. Thus, as illustrated in FIG. 8B, the flange portion 106*d* and the leg portion 106*c* are inserted into the oblong hole 105*a*, and the flange portion 106*d* and the leg portion 106*c* are slid in the X direction as illustrated in FIG. 8D, so that the frame member 106 is fixed to the support plate 105. In contrast, the frame member 106 can be detached from the support plate 105 by sliding the flange portion 106*d* and the leg portion

106*c* in the minus X direction from the state of FIG. 8D. Note that the contact relationship between the frame member 106 and the support plate 105 will be described later.

Figure 9A:
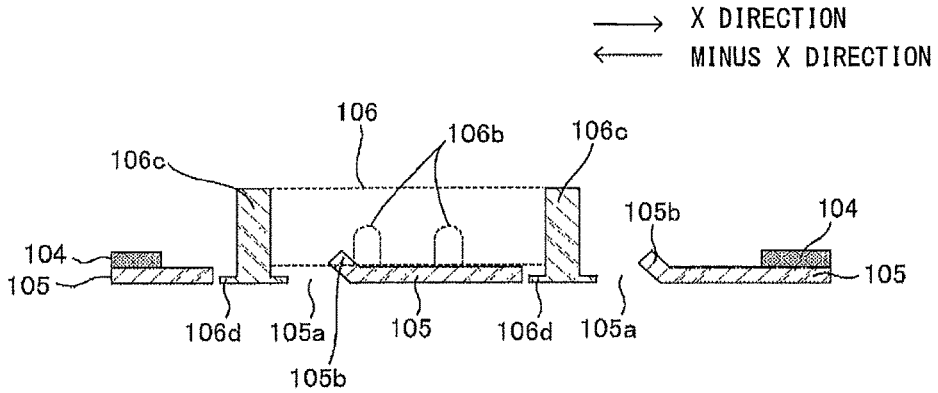
FIGS. 9A and 9B are sectional views of the frame member, the membrane sheet, and the support plate taken along line D-D of FIG. 1.
Figure 9B:
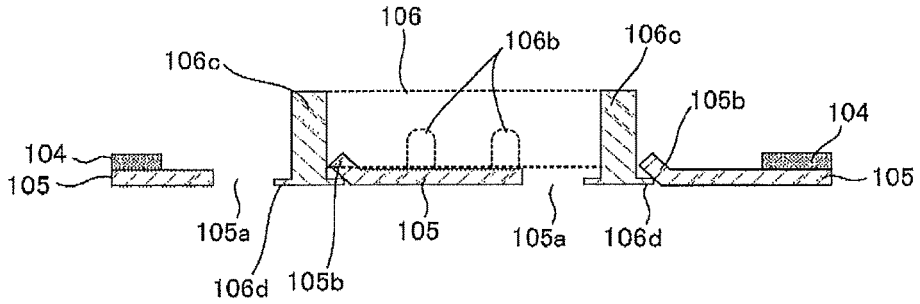

FIGS. 9A and 9B are sectional views of the frame member 106, the membrane sheet 104, and the support plate 105 taken along line D-D of FIG. 1. FIG. 9A indicates a state before the frame member 106 is fixed to the support plate 105. FIG. 9B indicates a state after the frame member 106 is fixed to the support plate 105. Also, in FIG. 9A, the frame member 106 is illustrated by a dotted line, except for the leg portions 106*c* and the flange portions 106*d*. When the leg portions 106*c* and the flange portions 106*d* are inserted into the respective oblong holes 105*a* of the support plate 105 as illustrated in FIG. 9A, the bottom portion of the frame member 106, except for the leg portions 106*c* and the flange portions 106*d*, comes into contact with the upper surface of the support plate 105. Then, when the flame member 106 is slid in the X direction from the state of FIG. 9, the flange portions 106*d* are respectively engaged with the projection portions 105*b* as illustrated in FIG. 9B, and the frame member 106 is fixed to the support plate 105. In other words, in FIG. 9B, the frame member 106 is fixed to the support plate 105 so as not to move upward and downward as the bottom portion of the frame member 106 is in contact with the upper surface of the support plate 105 and the flange portions 106*d* are respectively in contact with lower surfaces of the projection portions 105*b*.

Figure 10A:
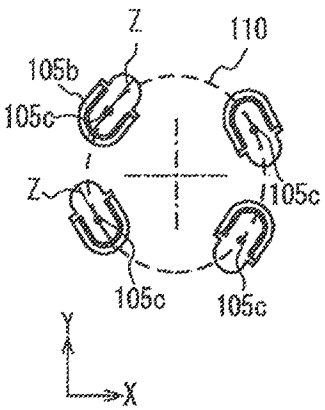
Figure 10A:
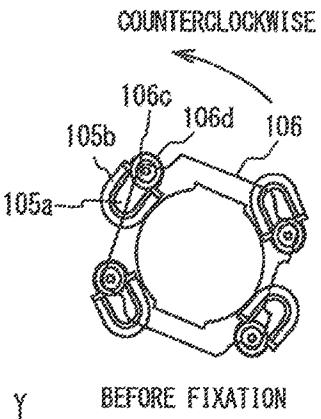
Figure 10A:
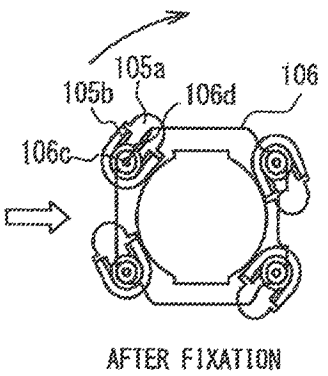
Figure 10C:
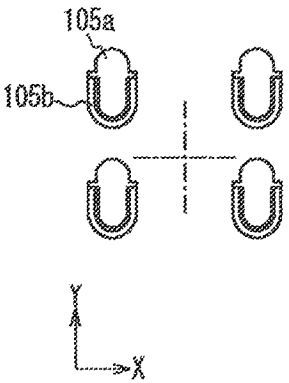
Figure 10C:
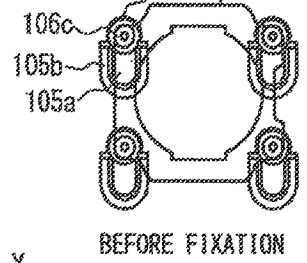
Figure 10C:
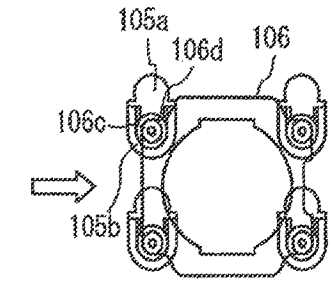

FIG. 10A is a view illustrating a first variation of the arrangement of the four oblong holes 105*a*. FIGS. 10B(1) and 10B(2) are views illustrating states before and after the frame member 106 is fixed to the support plate 105, respectively, in a case of employing the arrangement of the four oblong holes 105*a* illustrated in FIG. 10A FIG. 10C is a view illustrating a second variation of the arrangement of the four oblong holes 105*a*. FIGS. 10D(1) and 10D(2) are views illusrating states before and after the frame member 106 is fixed to the support plate 105, respectively, in a case of employing the arrangment of the four oblong holes 105*a* illustrated in FIG. 10C.

In FIG. 1, the four oblong holes 105*a* are provided in the support plate 105 such that major axes of the four oblong holes 105*a* are parallel with the X direction. As illustrated in FIG. 10A, however, the four oblong holes 105*a* may be provided in the support plate 105 such that each major axis Z of the four oblong holes 105*a* is tangent to the same periphery 110 passing through each center 105*c* of the oblong holes 105*a*. That is, the four oblong holes 105*a* may be provided in the support plate 105 such that the frame member 106 is rotated to be fixed to the support plate 105.

As illustrated in FIG. 10B(1), the flange portion 106*d* and the leg portion 106*c* of the frame member 106 are inserted into each oblong hole 105*a* in the state where the frame member 106 is not parallel with the X direction or the Y direction. Moreover, the frame member 106 is fixed to the support plate 105 by rotating the frame member 106 counterclockwise. In the state where the frame member 106 is fixed to the support plate 105, the frame member 106 is parallel with the X direction or the Y direction. In the state where the frame member 106 is fixed to the support plate 105, the frame member 106 can be detached from the support plate 105 by rotating the frame member 106 clockwise. In general, an operator does not need to push down the key top 102 so as to rotate the key top 102, so that the key switch device 100 can avoid being carelessly detached from the keyboard main body.

Also, as illustrated in FIG. 10C, the four oblong holes 105*a* may be provided in the support plate 105 such that major axes of the four oblong holes 105*a* are parallel with the Y direction. In this case, as illustrated in FIG. 10D(1), the flange portion 106d and the leg portion 106c of the frame member 106 are inserted into each oblong hole 105*a* in the state where the frame member 106 is parallel with the X direction or the Y direction. Further, the frame member 106 is fixed to the support plate 105 by sliding the frame member 106 in the minus Y direction. In the state where the frame member 106 is fixed to the support plate 105, the frame member 106 can be detached from the support plate 105 by sliding the frame member 106 in the Y direction.

Figure 11A:
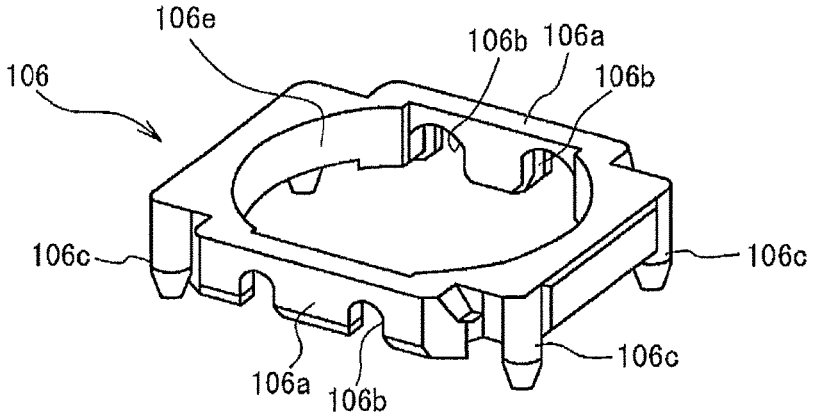
FIG. 11A is a structural view of the first variation of the frame member.

In FIG. 4, the flange portion 106*d* is provided at the end of the leg portion 106*c* of the frame member 106 beforehand. As illustrated in FIG. 11A, however, the flange portion 106*d* may not be provided in the end of the leg portion 106*c* of the frame member 106. In other words, the leg portion may have a stick shape such that the end thereof is thin and extends vertically downward.

Figure 12A:
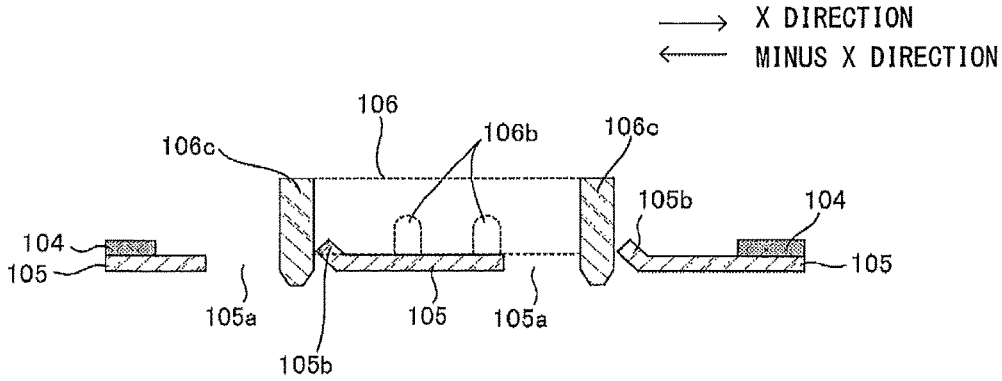
FIG. 12A is a sectional view of the frame member illustrated in FIG. 11A before thermal caulking.
Figure 12B:
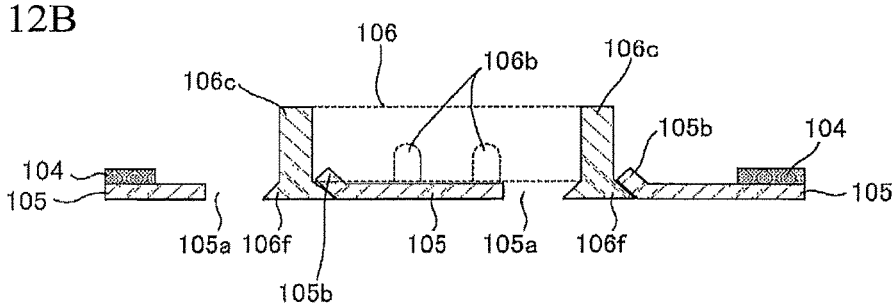
FIG. 12B is a sectional view the frame member illustrated in FIG. 11A after thermal caulking.

FIG. 12A is a sectional view of the frame member 106, the membrane sheet 104, and the support plate 105 of FIG. 11A. Since the end of the leg portion 106*c* of the frame member 106 in FIG. 11A is not provided with the flange portion, the frame member 106 cannot be fixed to the support plate 105 in this state. Thus, as illustrated in FIG. 12B, the end of the leg portion 106*c* penetrating through the oblong hole 105*a* is deformed by thermal caulking, which causes the end of the leg portion 106*c* to be formed with a flange portion 106*f* having a diameter greater than the width Cl of the projection portion 105*b* mentioned above. Thus, the frame member 106 is fixed to the support plate 105. Also, in the case where the end of the leg portion 106*c* is formed with the flange portion 106*f*, the frame member 106 can be detached from the support plate 105 by sliding the frame member 106 in the minus X direction.

Figure 11B:
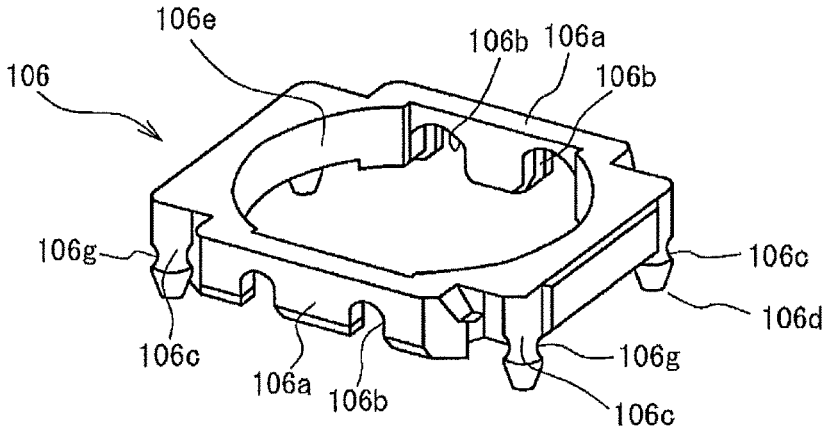
FIG. 11B is a structural view of the second variation of the frame member.

Also, as illustrated in FIG. 11B, a thin portion 106*g* may be formed in the vicinity of the end of the leg portion 106*c*. It is thus possible to avoid filling the oblong hole 105*a* with a resin melted by thermal caulking.

As described above, according to the embodiment, the frame member 106 includes the leg portions 106*c* extending downward, and the flange portions 106*d* respectively provided in the ends of the leg portions 106*c*. The support plate 105 includes the oblong holes 105*a* through which the leg portions 106*c* and the flange portions 106*d* of the frame member 106 respectively penetrate, and the projection portions 105*b* respectively protruding angularly upwardly from parts of the outer peripheries of the oblong holes 105*a* to the insides of the oblong holes 105*a*. Thus, the leg portions 106*c* and the flange portions 106*d* are respectively inserted into the oblong holes 105*a*, and are slid in a predetermined direction (for example, in the X direction), whereby the frame member 106 is fixed to the support plate 105. In contrast, the leg portions 106*c* and the flange portions 106*d* can be slid in the direction opposite to the predetermined direction (for example, in the minus X direction), whereby the frame member 106 can be detached from the support plate 105. Accordingly, a repairer can disassemble and repair the key switch device 100 with ease. Also, only a defective key (the key top 102, the frame member 106, the link member 103, or the dome rubber 104*b*) can be replaced, thereby reducing waste matters. Also, a detached key top 102, a detached frame member 106, a detached pair of the link members 103, and a detached dome rubber 104*b* can be reused unless they are broken. Further, in the case where the end of the leg portion 106*c* of the frame member 106 is provided with the flange portion 106*d* beforehand, since a jig for thermal caulking is not needed, the cost of the production facility of the key switch device can be reduced.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A key switch device comprising:

a key top that includes an operating surface;

a pair of link members that is interlocked with each other to move the key top upward and downward;

a frame member that includes a leg portion extending downward and a flange portion provided at an end of the leg portion, and pivotably supports the pair of the link members; and a support plate that includes an oblong through hole through which the leg portion and the flange portion penetrate, and a projection portion projecting upwardly from a part of an outer periphery of the oblong through hole toward an inside of the oblong through hole, wherein the oblong through hole is configured such that the frame member is horizontally slidable between a first position of the oblong through hole where the flange portion engages with the projection portion and a second position of the oblong through hole where the flange portion is removed from the projection portion.

2. The key switch of claim 1, wherein the projection portion has a U shape in top view, and an inner width of the U shape is greater than a diameter of the leg portion and smaller than a diameter of the flange portion.

3. The key switch of claim 1, wherein the oblong through hole is arranged in the support plate such that the frame member is rotated to be fixed to the support plate.

4. The key switch of claim 1, wherein the flange portion is formed by thermal caulking.

5. The key switch of claim 4, wherein a thin portion is formed in a vicinity of an end of the leg portion.

6. A keyboard, comprising:

a support plate;

a plurality of key switch devices, each of the key switch devices including a key top;

a pair of link members that is interlocked with each other and support the key top so as to move upward and downward; and a frame member that includes a leg portion extending downward and a flange portion provided at an end of the leg portion, and pivotably supports the pair of the link members, wherein the support plate includes an oblong through hole through which the leg portion and the flange portion penetrate, and a projection portion projecting upwardly from a part of an outer periphery of the oblong through hole toward an inside of the oblong through hole, and wherein the oblong through hole is configured such that the frame member is horizontally slidable between a first position of the oblong through hole where the flange portion engages with the projection portion and a second position of the oblong through hole where the flange portion is removed from the projection portion.

7. A key switch device comprising:

a key top that includes an operating surface;

a pair of link members that is interlocked with each other to move the key top upward and downward;

a frame member that includes a leg portion extending downward and a flange portion provided at an end of the leg portion, and pivotably supports the pair of the link members; and a support plate that includes a through hole through which the leg portion and the flange portion penetrate, and a projection portion projecting upwardly from a part of an outer periphery of the through hole toward an inside of the through hole, wherein the projection portion has a U shape in top view, and wherein an inner width of the U shape is greater than a diameter of the leg portion and smaller than a diameter of the flange portion.

* * * * *